US005140722A

United States Patent [19]

Akiyama

[11] Patent Number: 5,140,722

[45] Date of Patent: Aug. 25, 1992

[54] SLIVER PIECING DEVICE HAVING FIBER ENTANGLING NEEDLES AND AIR JETS

[75] Inventor: Yasuo Akiyama, Kyoto, Japan

[73] Assignee: Murata Kikai Kabushiki Kaisha, Kyoto, Japan

[21] Appl. No.: 625,768

[22] Filed: Dec. 5, 1990

[30] Foreign Application Priority Data

Dec. 8, 1989 [JP] Japan ..... 1-317625
Feb. 7, 1990 [JP] Japan ..... 2-26100

[51] Int. Cl.[5] ..... D01G 25/00; D01G 27/00

[52] U.S. Cl. ..... 19/150; 19/157; 28/104; 28/107

[58] Field of Search ..... 19/150, 157, 159 R, 19/159 A; 226/10, 11, 36; 28/103-105, 108, 107; 57/22, 23, 90, 261, 266, 267, 276, 281; 242/35.6 E, 37

[56] References Cited

U.S. PATENT DOCUMENTS 2,608,725 9/1952 Strew ..... 19/157
2,731,183 1/1956 Shaw ..... 28/108 X
3,012,398 12/1961 Merkle ..... 57/22 X
3,308,520 3/1967 Gagnon ..... 19/157 X
3,340,586 9/1967 Zocher ..... 28/108
3,409,959 11/1968 Barboni ..... 28/108
4,445,318 5/1984 Becker et al. ..... 57/22
4,982,563 1/1991 Stahlecker ..... 19/159 A

FOREIGN PATENT DOCUMENTS 0389439 7/1990 European Pat. Off. ..... 57/22
0275658 1/1990 Fed. Rep. of Germany ..... 57/22

*Primary Examiner*—Werner H. Schroeder
*Assistant Examiner*—Ismael Izaguirre
*Attorney, Agent, or Firm*—Spensley Horn Jubas & Lubitz

[57] ABSTRACT

A sliver piecing device includes a pair of holding members for piling and holding ends of slivers to be pieced, and a plurality of needles extending through the holding members and being inserted into the slivers to force the fibers into the other sliver and to intertwine the fibers with each other. In a further embodiment of the piecing device, pressurized air may be used, along with the needles, to force the fibers of one sliver into the other and to intertwine the fibers with each other.

6 Claims, 3 Drawing Sheets

SLIVER PIECING DEVICE HAVING FIBER ENTANGLING NEEDLES AND AIR JETS

CROSS-REFERENCE TO RELATED APPLICATIONS

This application claims the priority of Japanese Application No. 1-317 625 filed Dec. 8th, 1989, and Japanese Application No. 2-26 100 filed Feb. 7th, 1990, both of which are incorporated herein by reference.

BACKGROUND OF THE INVENTION

1. Field of the Invention

The present invention relates to a sliver piecing device for piecing ends of slivers in a fine spinning machine.

2. Description of the Related Art

A fine spinning frame of a pneumatic type or an open end type is to produce spun yarns from the sliver.

For example, the pneumatic fine spinning frame is designed so that as shown in FIG. 6, a sliver S placed in a sliver can 1 is pulled out, the sliver S is drawn and arranged by a draft mechanism 2 and at the same time applied with a twist by a turning flow caused by an air jet nozzle 3, and the produced spun yarn Y is wound on a bobbin 4. When the sliver S in the sliver can 1 is reduced in quantity, an old can is replaced by a new one, and a distal end S1 of sliver of the old and a start end S2 of sliver of new can should be pieced.

The sliver is an assembly of fibers in which short fibers are substantially parallel with each other and in the form of web or rope. The fibers tend to fall into pieces depending on the handling, and therefore, mechanization (automation) of sliver piecing for piecing ends of slivers has been difficult to realize. For this reason, as matter now stands, the ends of the slivers are pieced manually by an operator, which is a troublesome work, thus desiring the mechanization. Replacement of cans can be easily mechanized but sliver piecing is hard to be mechanized, which leads to a difficulty of automatic continuous operation of a fine spinning frame. The sliver piecing poses a bottleneck of automation of a spinning mill.

SUMMARY OF THE INVENTION

It is therefore an object of the present invention to solve the aforesaid problem and provide a sliver piecing device which can piece ends of slivers, renders possible automatic continuous operation of a fine spinning frame and in which a spinning mill can be automated.

For achieving the aforesaid object, the present invention provides a device comprising a pair of holding members for piling and holding ends of slivers to be pieced, and a plurality of needles extending through said holding members and being inserted into the sliver to force the fibers into the other sliver.

In carrying out the sliver piecing, first, ends of slivers to be pieced are piled and held by the holding members. Then, when the needles are made to extend through the holding members and inserted into the sliver, fibers of one sliver is forced into the other sliver and the fibers are intertwined with each other whereby the ends of the slivers are connected together. Since the ends of the slivers can be mechanically pieced, mechanization of sliver replacement as well as automatic continuous operation of a fine spinning frame are rendered possible and the spinning mill can be automated.

DESCRIPTION OF THE PREFERRED EMBODIMENTS

One embodiment of the present invention will be described hereinafter with reference to the accompanying drawings.

Figure 1:
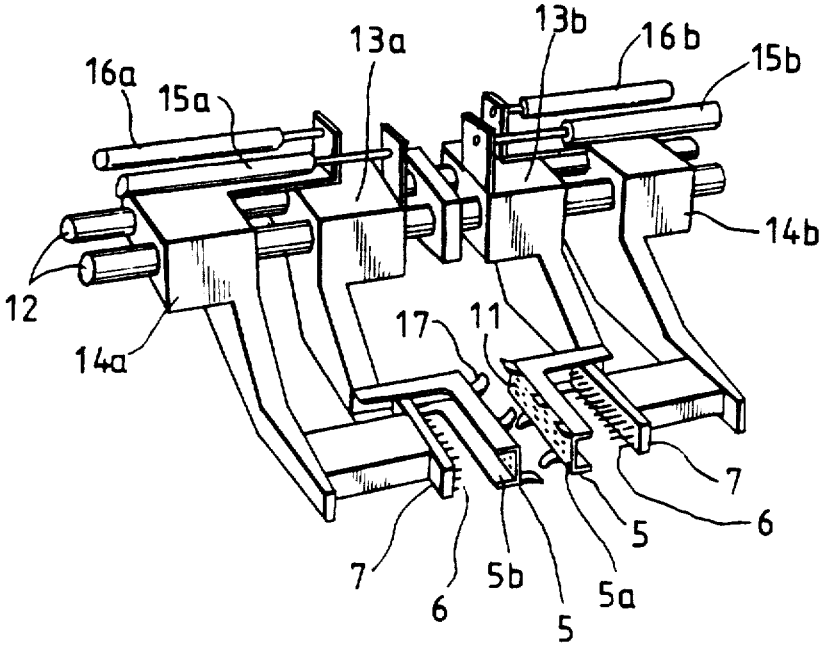
FIG. 1 is a perspective view showing one embodiment of a sliver piecing device according to the present invention.
Figure 2:
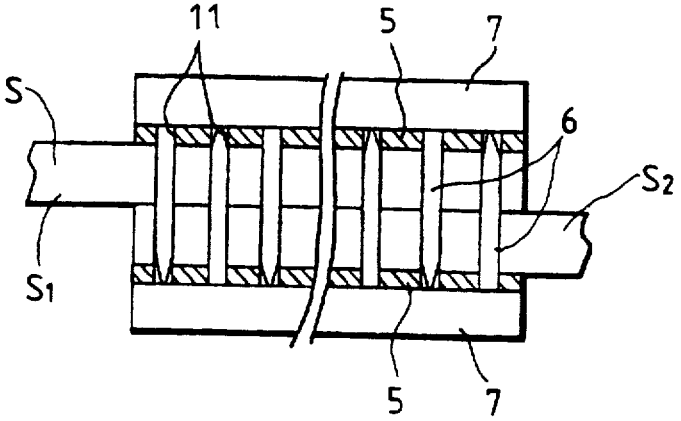
FIG. 2 is an enlarged view explaining the operation of the device.
Figure 3:
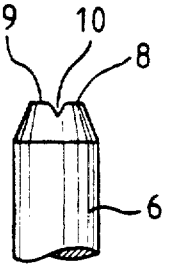
FIG. 3 is an enlarged side view of a needle used for the device.
Figure 4:
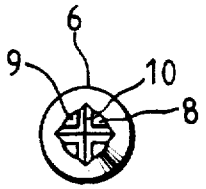
FIG. 4 is a plan view of the needle.

In FIGS. 1 and 2 showing the sliver piecing device, reference numeral 5 designates a pair of holding members for piling and holding ends S1 and S2 of slivers S to be pieced, and externally of the holding members 5 are arranged a plurality of needles 6 which extend through the holding members 5 are inserted into the sliver S. The needles 6 are provided on both base plates 7 so that they are not interferred from each other when they are inserted into the sliver S at right angles from both sides. As shown in FIGS. 3 and 4, at the extreme end of the needle 6 is formed an engaging portion 8 for catching fibers constituting a sliver so that fibers of one sliver are forced into the other sliver. In the illustrated engaging portion 8, a V-shaped groove 10 is formed crosswise in a surface 9 formed by cutting the extreme end of the needle 6 at right angle. However, the V-shaped groove 10 may be formed radially, or the surface 9 is merely scratched.

The holding member 5 is formed from an L-shaped member having a groove shape in section as shown in FIG. 1, and a holding surface 5*a* thereof is formed with through-holes 11 corresponding to the needles 6 on both sides. The base plate 7 of the needle 6 is guided along the groove 5*b* of the holding member 5. In order that the holding members 5 and the base plates 7 of the needles 6 may be moved to and from each other, these are secured to two sets of sliders 13*a*, 13*b*, 14*a* and 14*b* slidably supported on guide rods 12, the sliders 13*a*, 13*b*, 14*a* and 14*b* being driven by cylinders 15*a*, 15*b*, 16*a* and 16*b*. Reference numeral 17 designates sliver guide members formed on both sides of the holding surface 5*a*.

The operation of the above-described embodiment will be described hereinafter.

In carrying out the sliver piecing, first, the holding members 5 are moved to close each other so that the ends S1 and S2 of the slivers S are piled and held. In this case, the ends of the slivers S may be piled manually, but for example, the ends of the slivers S may be gripped by a clamping device and carried between the holding members 5 and the ends may be piled.

Figure 5:
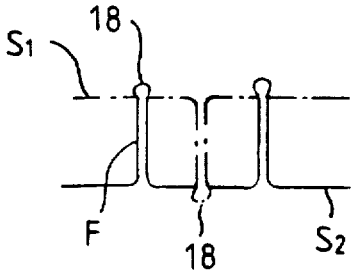
FIG. 5 is a view schematically showing the sliver piecing state.
Figure 6:
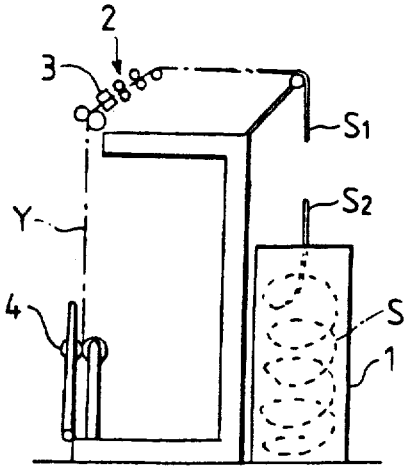
FIG. 6 is a side view of a fine spinning frame.

After the ends S1 and S2 of the slivers S have been held in the piling direction by the holding members 5, the base plates 7 of the needles 6 are moved to close to each other, and the needles 6 are made to extend through the holding members 5 and inserted into the sliver S. Then, the fiber F of one sliver is forced into the other sliver as shown in FIG. 5 by the engaging portion 8 at the extreme end of the needle, and the fibers F are intertwined each other whereby the ends S1 and S2 of the slivers S are connected together. Particularly in this case, the fibers F of one sliver extend through the other sliver to form a loop 18, and therefore, the connection between the ends of the slivers S becomes rigid.

After termination of the sliver piecing as described above, the base plates 7 of the needles 6 are moved away from each other to remove the needles 6 from the sliver S and the through-hole 11 of the holding member 5, and the holding members 5 may be moved away from each other.

In this manner, the ends S1 and S2 of the slivers S can be mechanically pieced. Therefore, mechanization of can replacement as well as automatic continuous operation of a fine spinning frame are rendered possible, and the spinning mill can be automated.

In short, according to the present invention, the plurality of needles are inserted from both sides in the state where the ends of the slivers to be pieced are piled, and the fibers of one sliver are forced into the other sliver by the extreme end of the needles. Therefore, the ends of the slivers can be positively connected, and the sliver piecing can be mechanized. Therefore, mechanization of can replacement as well as automatic operation of the fine spinning frame are rendered possible, and the spinning mill can be automated.

Another embodiment of the present invention will be described hereinafter.

It is provided a device comprising a guide groove for piling and receiving ends of slivers to be pieced, a defining member having a plurality of needles which extend through a bottom of said groove and are inserted into the ends of the slivers, a pressing member for pressing the ends of the slivers in the groove, and pressure air jet holes formed in at least one member while facing to the ends of the slivers.

In carrying out the sliver piecing, the ends of the slivers are piled and received into the guide groove, the plurality of needles of the defining member are extended through the bottom of the groove and inserted into the sliver ends, and the sliver ends are pressed by the pressing member, in which state the pressure air is jetted against the sliver ends from the pressure air jet holes.

When the plurality of needles are inserted into the ends of the slivers, the fibers of the end of one sliver piled are forced into the fibers of the end of the other sliver, and the fibers are intertwined together by a stream of pressure air. Therefore, the ends of the slivers are positively connected together. Large movement of the fibers of the ends of the slivers is defined by the needles and the fibers are pressed by the pressing member within the groove. Therefore, the fibers are not scattered by the pressure air.

Since the ends of the slivers can be mechanically pieced, mechanization of sliver replacement as well as automatic continuous operation of a fine spinning frame are rendered possible and the spinning mill can be automated.

Another embodiment will be described with reference to the accompanying drawings.

Figure 7:
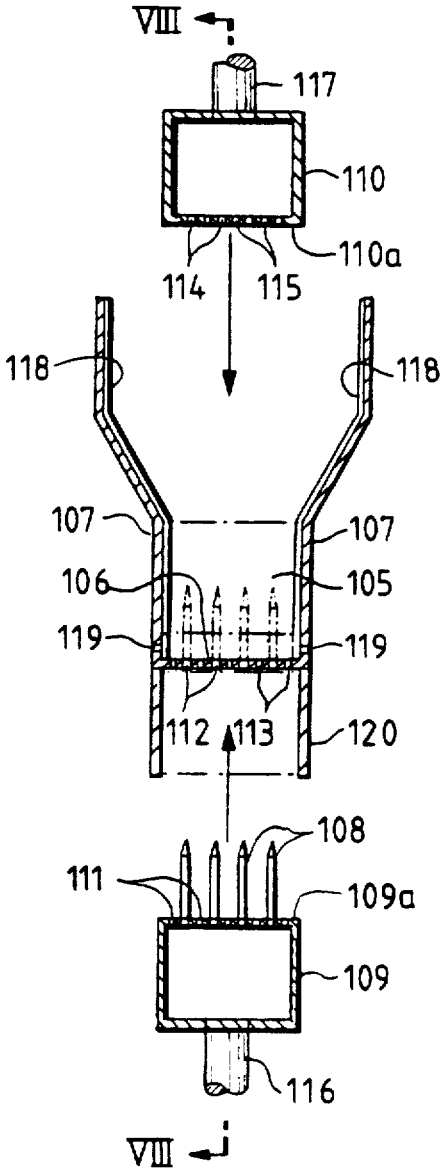
FIG. 7 is a sectional view showing another embodiment of a sliver piecing device.
Figure 8:
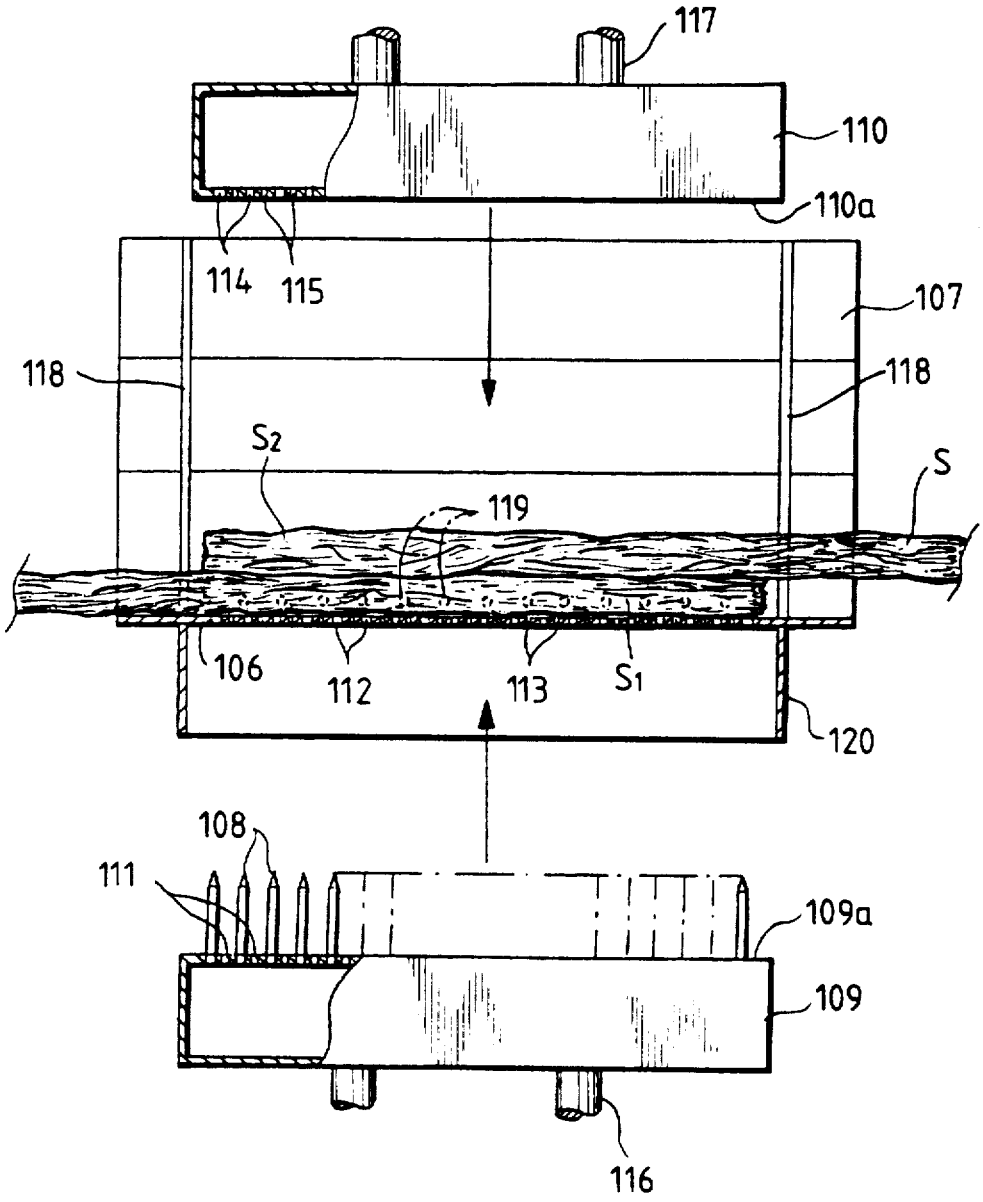
FIG. 8 is a sectional view taken on line VIII —VIII of FIG. 7.

In FIGS. 7 and 8 showing a sliver piecing device, reference numeral 105 designates a guide groove for piling and receiving ends S1 and S2 of slivers S to be pieced. The guide groove 105 is defined by a bottom plate 106, and guide plates 107 provided on both sides thereof. Externally of the outer bottom of the guide groove 105 is provided a defining member 109 having a plurality of needles 108 which extend through said outer bottom and are inserted into the sliver S and a pressing member 110 for pressing the sliver S is provided within the guide groove 105 so that they may be moved to and away at right angles from the bottom of the guide groove 105. While in the present embodiment, the defining member 109 and the pressing member 110 are moved with respect to the fixed guide groove 105, it is to be noted that the guide groove 105 and the pressing member 110 are moved with respect to the fixed defining member 109.

Both the defining member 109 and the pressing member 110 are formed from a hollow box-like rectangular body, both of which are moved to and away from the guide groove 105 by means of a drive mechanism not shown such as a cylinder, a cam or the like. On the face 109*a* on the guide groove side of the defining member 109 are provided a plurality of needles 108 widthwise and lengthwise in a predetermined spaced relation, and a plurality of pressure air jet holes 111 having a small diameter are formed to be positioned between the needles 108.

The bottom plate 106 of the guide groove 105 is formed with needle holes 112 through which the needles 108 of the defining member 109 extend and pressure air holes 113 corresponding to the pressure jet holes 111. The surface (pressing surface) on the guide groove side of the pressing member 110 is formed with needle holes 115 through which the needles 108 of the defining member 109 extend and a plurality of pressure air jet holes 115 positioned between the needle holes 114. Pressure air supply pipes 116 and 117 for supplying compression air are connected to the defining member 109 and the pressing member 110.

The guide plates 107 have their upper portions spread opened from the guide groove 105 portion receiving the pressing member 110, and a guide rail 118 for guiding the pressing member 110 is provided on the inner walls opposed to each other so that the pressing member 110 can be easily moved while being located in the guide groove 105. A plurality of escape holes 119 having a small diameter to let pressure air escape outside the groove are formed in the neighbourhood of the bottom of the guide groove of the guide plates 107.

The bottom plate 106 is provided with a guide frame 120 to cover the circumference of th side of the defining member 109 so as to guide the defining member 109 while being located and to prevent pressure air from being escaped.

The operation of the above-described embodiment will be described hereinafter.

The defining member 109 and the pressing member 110 are in a standby position away from the guide groove 105, and an end S1 of one sliver to be pieced (for example, a terminal end of sliver of an old can) is inserted into the guide groove 105, and an end S2 of the other sliver (a start end of sliver of a new can, for example) is inserted therein so that both ends are placed one above the other. This inserting work is so simple that it can be done manually. However, for example, the ends S1 and S2 are held by a clamp device so as to alternately insert them into the guide groove 105.

Next, the defining member 109 and the pressing member 110 are moved toward each other simultaneously or with the defining member 109 delayed, and the sliver ends S1 and S2 within the guide groove 105 are pressed by the pressing member 110. The needles 108 of the defining member 109 are made to extend through the needle holes 112 of the bottom plate 106 and inserted into the needle holes 114 of the pressing member 110. When the plurality of needles 108 are inserted into the sliver ends S1 and S2, the piled fibers of the end S1 of one sliver are forced into the fibers of the end S2 of the other sliver by means of these needles 108.

In this state, the pressure air supply pipes 116 and 117 are operated by valves so that first, pressure air is jetted out of the pressure jet holes 115 of the pressing member 110, and after stoppage of said jet, pressure air is jetted out of the pressure air jet holes 111 of the defining member 109. This jetting order may be reversed. The fibers are intertwined together by the stream of the pressure air to be jetted whereby the ends S1 and S2 of the slivers are positively connected and pieced together. Particularly, if jetting of pressure air is alternately carried out, the first jetting causes the fibers of the upper sliver end S2 to be intertwined with the fibers of the lower sliver end S1, and the second jetting causes the fibers of the lower sliver end S1 to be intertwined with the fibers of the upper sliver end S2 whereby the intertwining therebetween becomes rigid. In the jetting of the pressure air, the fibers of the sliver ends S1 and S2 are controlled in their large movement by the needles 108 and pressed by the pressing member 110 into the guide groove 105. Therefore, the fibers are not scattered by the pressure air.

After the sliver piecing has been terminated as described above, the defining member 109 and the pressing member 110 may be moved away from the guide groove 105. When the needles 108 are removed, the sliver S tends to move along the needles 108, but the sliver is left within the groove 105 by the bottom plate 106.

In this manner, the ends S1 and S2 of the slivers can be mechanically pieced together. Therefore, mechanization of can replacement as well as automatic continuous operation of the fine spinning frame are rendered possible, and the spinning mill can be automated.

While in the embodiment, the pressure air is jetted against both the defining member 109 and the pressing member 110, it is to be noted that either one of them may be provided with the pressure air jet holes 111 and 115. In addition, while the pressing surface 110*a* of the pressing member 110 is formed into a flat configuration, it is to be noted that the surface 110*a* can be formed into a recessed surface so that the sliver S may be easily bundled.

In short, according to this embodiment of the present invention, the ends of the slivers can be positively connected together without scattering the fibers by the action of forcing the fibers by means of the plurality of needles of the defining member and the defining action and the intertwining action of the fibers by the pressure air and the sliver piecing can be mechanized. Therefore, the mechanization of can replacement as well as the automatic continuous operation of the fine spinning frame and the spinning mill can be automated.

What is claimed is:

1. A device for piecing a plurality of slivers, at least one of the plurality of slivers comprising a plurality of fibers and defining at least one end, the device comprising:

a supporting member for piling and holding the ends of slivers to be pieced, the supporting member comprising a first portion and a second portion;

a first member comprising a plurality of needles extendable through the first portion of the supporting member and insertable into the ends of the slivers such that the fibers of one of the plurality of slivers become intertwined with the fibers of at least another of the plurality of slivers; and a second member positioned in spaced relation to the first member, the second member comprising a plurality of needles extendable through the second portion of the supporting member and insertable into the ends of the slivers such that the fibers of one of the plurality of slivers become intertwined with the fibers of at least another of the plurality of slivers;

wherein at least one of the plurality of needles comprises an extreme end, the extreme end defining a first V-shaped groove, the first V-shaped groove defining a longitudinal axis.

2. The device of claim 1, wherein the extreme end defines a second V-shaped groove, the second V-shaped groove defines a longitudinal axis, and the longitudinal axes of the first and second V-shaped grooves defines an angle equal to approximately 90 degrees.

3. A device for piecing a plurality of slivers, at least one of the plurality of slivers comprising a plurality of fibers and defining at least one end, the device comprising:

a pair of holding members for piling and holding slivers to be pieced; and a plurality of needles extendable through a portion of the holding members and insertable into the ends of the slivers such that the fibers of one of the plurality of slivers become intertwined with the fibers of at least another of the plurality of slivers, at least one of the plurality of needles comprising an extreme end defining a first V-shaped groove for catching fibers of the slivers, the first V-shaped groove defining a longitudinal axis.

4. The device of claim 3, wherein the extreme end defines a second V-shaped groove, the second V-shaped groove defines a longitudinal axis, and the longitudinal axes of the first and second V-shaped grooves define an angle equal to approximately 90 degrees.

5. A device for piecing a plurality of slivers, at least one of the plurality of slivers comprising a plurality of fibers and defining at least one end, the device comprising:

a supporting member for piling and holding the ends of slivers to be pieced, the supporting member comprising a plurality of needle holes and a plurality of air holes;

a first moveable member arranged in spaced relation to the supporting member, the first moveable member comprising a plurality of needles extendable through the first plurality of needle holes and insertable into the ends of the slivers and air supply means for forcing air through the air holes in the supporting member; and a second movable member arranged in spaced relation to the supporting member, the second moveable member comprising a plurality of needle holes for receiving the plurality of needles and air supply means for forcing air through the air holes in the supporting member.

6. The device of claim 5, wherein at least one of the plurality of needles comprises an extreme end, the extreme end defining a point.

* * * * *